United States Patent [19]

Bachmann et al.

[11] Patent Number: 4,654,122

[45] Date of Patent: Mar. 31, 1987

[54] ENDLESS WIRE BELT FOR PAPER MACHINES OR THE LIKE

[75] Inventors: Wolfgang Bachmann, Dreieich-Sprendlingen; Dieter Spahn, Hanau, both of Fed. Rep. of Germany

[73] Assignee: Asten Group, Inc., Devon, Pa.

[21] Appl. No.: 716,358

[22] Filed: Mar. 26, 1985

[51] Int. Cl.[4] ..... D21F 1/10; D21F 7/08; B32B 5/12

[52] U.S. Cl. ..... 162/348; 162/358; 162/DIG. 1; 428/90; 428/222; 139/383 A

[58] Field of Search ..... 162/348, 358, DIG. 1; 428/222, 236, 255, 282, 288, 90; 139/383 A, 425 A

[56] References Cited

U.S. PATENT DOCUMENTS

| | | | |
|---|---|---|---|
| 4,107,367 | 8/1978 | Fekete | 162/358 |
| 4,187,618 | 2/1980 | Diehl | 162/358 |
| 4,346,138 | 8/1982 | Lefferts | 428/222 |
| 4,362,776 | 12/1982 | Lefferts et al. | 428/222 |
| 4,369,218 | 1/1983 | Mazére | 162/358 |
| 4,381,612 | 5/1983 | Shank | 34/116 |
| 4,392,902 | 7/1983 | Lefferts | 156/161 |
| 4,395,308 | 7/1983 | Dawes | 162/232 |
| 4,421,809 | 12/1983 | Bish et al. | 428/90 |
| 4,423,543 | 1/1984 | Leuvelink | 29/433 |
| 4,481,079 | 11/1984 | Dawes | 162/348 |
| 4,490,925 | 1/1985 | Smith | 34/42 |
| 4,520,065 | 5/1985 | Leo | 428/222 |
| 4,528,236 | 7/1985 | Finn et al. | 428/222 |

FOREIGN PATENT DOCUMENTS 3243512 7/1984 Fed. Rep. of Germany .

OTHER PUBLICATIONS

Certified Translation of French Language PCT International Application, Ser. No. PCT/FR 81/00147.

Certified Translation of French Language PCT International Application, Ser. No. PCT/FR 81/00146.

*Primary Examiner*—S. Leon Bashore
*Assistant Examiner*—Andrew J. Anderson
*Attorney, Agent, or Firm*—Benasutti and Murray

[57] ABSTRACT

In order to avoid marking by the supporting surfaces in an endless belt for paper machines or the like with a number of helices consisting of opposing winding legs and headcurves joining these flanks together and into whose intermediary spaces the headcurves of the neighboring helix are forced to a degree that there develops between the two helices a range of overlapping into which a rod is inserted and in order to create the possibility for regulating the flow of air through the wire belt, at least the paper web-supporting winding legs of the helices are glued with a layer of fiber segments. Additionally, in such an endless belt permeability may be controlled by providing fiber segments on the winding legs and/or on the side areas adjacent the loop flanks.

21 Claims, 9 Drawing Figures

FIG. 3
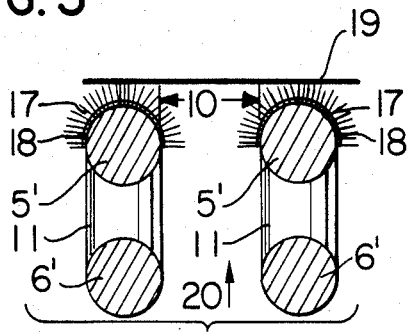
FIG. 5
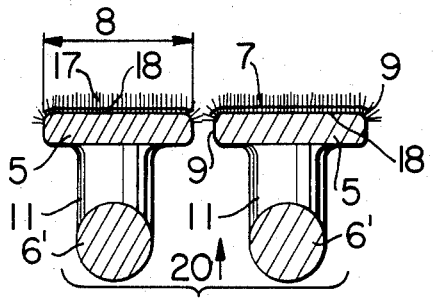
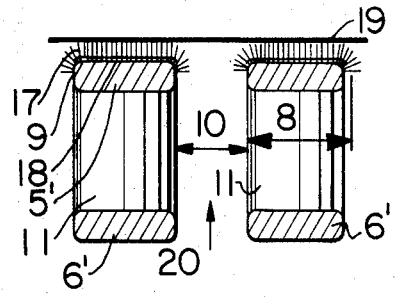
FIG. 4
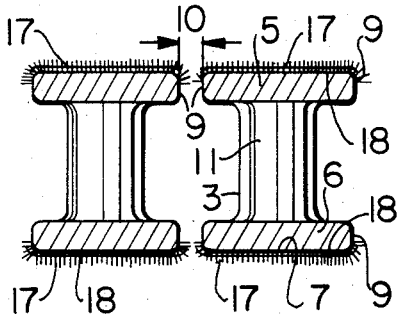
FIG. 6
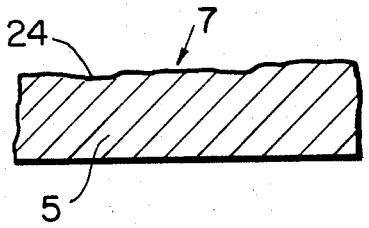
FIG. 7
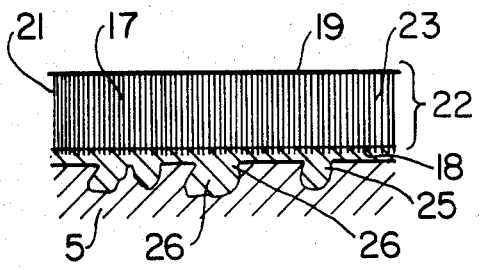
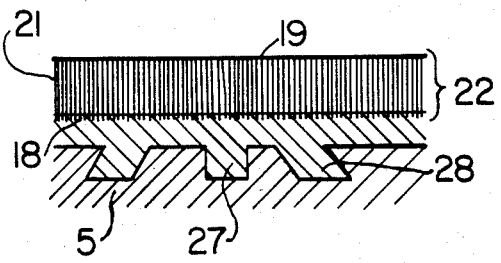
FIG. 8
FIG. 9

ENDLESS WIRE BELT FOR PAPER MACHINES OR THE LIKE

BACKGROUND OF THE INVENTION

1. Field of the Invention

The invention relates to an endless papermakers belt for paper machines or the like with a number of helices which consist of opposing winding legs and headcurves joining those legs together and into whose intermediary spaces the headcurves of the neighboring helix are entered to a degree such that there develops between the two helices a range of overlapping into which a rod or pintle is inserted.

2. Description of the Prior Art

Such belts are described, for example, in German Pat. No. 2,419,751 and in German Patent (Disclosure copy) No. 2,938,221. In both cases, the helices consist of wire usually with a round or slightly oval cross-section. Such wire belts exhibit an exceptionally high air permeability. In the manufacture of paper, this often leads to paper flutter.

In addition, there is the fact that usually only one so-called contact point occurs between these known belts and the paper web at the supporting winding legs. Depending on the weight and quality of the paper and the pressing pressure occurring during manufacture, this can lead to impressions of the winding legs being visible in the finished paper. To be sure, these impressions are desired, for example, in papers whose surface is supposed to exhibit a pattern; in the manufacture of high-quality smooth papers, in contrast, these impressions are to be avoided.

Also known are wire belts in which at least the web-supporting winding legs of the helices exhibit flat supporting surfaces. These flat supporting surfaces may be produced, for example, when flat wires or shaped monofilaments are used in manufacturing the helices. This has the disadvantage, however, that one must accept between neighboring winding legs a large air passage which is generally of the width of the flat wires or shaped monofilaments and which in many cases should be avoided. The prior art has attempted in complicated fashion to regulate the passage of air in such wire belts using various types of inserts within the helices. This, however, results in reduced mobility between neighboring helices of the belt, especially in turning around rolls. The introduction of the inserts is an intensive process and they can increase the weight of the belts very considerably.

Known finally are endless belts for paper machines in which at least the web-supporting winding legs of the helices exhibit flat supporting surfaces whose width is greater than the wire diameter or than the wire width of the headcurves (German Pat. No. 3,243,512).

By varying the width of the supporting surfaces of the helices, one can influence the passage of air through the wire belts over a broad range. In addition, there is the fact that the relatively wide supporting surfaces avoid pointwise contact between the belts and the paper web which is one difficulty with the prior art belts.

It has been found, however, in operating these wire belts that slight irregularities or roughenings in the supporting surfaces adversely affect the manufacture of high-quality papers in which even the slightest marking must be avoided.

It has already been proposed to needle such belts with a mat consisting of very many thin compacted textile filaments.

The difficult thing is to guarantee permanent consolidation of the mats on the wire belts. It has been found that, especially upon turning of the belts around rolls, relative movement occurs between the belt and the mat needled thereto, which, over the long term (especially at the high operating speeds of modern equipment) leads to a loosening of the mat from the belt over the course of time.

In addition, there is the fact that previously used mats have been relatively air-tight so that they permit influencing the flow of air through them only to a limited degree. A serious problem here is that, as a result of an abrasion of the mat and the paper web, a fine dust is formed which clogs the porous openings in the mat. The consequence of this is that the air permeability of such mat-needled endless belts descreases and finally becomes insufficient.

SUMMARY OF THE INVENTION

In comparison with the prior art, the present invention is aimed at avoiding the above-described disadvantages and providing a wire belt which, to be sure, also possesses a suitable support for the manufacture of the finest paper grades, which, however, does not become clogged over its entire service life, but rather guarantees practically constant air flow in spite of wearing of the mat and the paper web.

It has been found that this goal can be attained in simple fashion by adhering a layer of natural and/or synthetic fiber segments to at least the web-supporting winding legs of the helices.

Such layers insure proper support during the manufacture of even the finest papers and leave behind practically no impressions in the forming paper web. Through the gluing process, one can apply the fiber segments more or less dense and can use a specific material or material combination.

Of particular advantage of the present invention is the fact that the initial air permeability of the belt is retained for all practical purposes. It appears that on the one hand, the passage of air through the wire belt would become somewhat greater as a result of wearing of the fiber segments; on the other hand, however, there develops through the abrasion of the fiber segments and the paper web a fine dust which becomes deposited in the layer of fiber segments. It is believed that as a result of these two factors, the initial air permeability of the wire belt is practically unchanged over the entire service life of the belt.

The coating or layer of fiber segments can be applied to all belts manufactured from helices regardless of the shape of the supporting winding legs. The fiber segments take effect with particular advantage, however, when the supporting winding legs exhibit flat supporting surfaces which are provided with an adhesive layer with respect to which the fiber segments are oriented in a substantially perpendicular direction.

In a preferred embodiment, the edge areas of the flat supporting surfaces are also provided with an adhesive layer with respect to which the fiber segments are oriented in a substantially perpendicular direction.

In addition, if one desires to control only the air permeability of the belt the layer of fiber may be adhered only to the side edges of the web-supporting winding legs of the helices.

The roughening of the surfaces to be provided with the adhesive layer can take place in various ways. Good results are attained when the roughenings exhibit depressions caused by chemical etching. These etchings are attained with devices which make sure that only the desired regions of the surfaces of the wire belts are roughened. The roughened surfaces are provided with adhesive either by doctoring on or in an immersion bath in which the surfaces to be provided with adhesive are just barely immersed.

In one embodiment of the invention, a caustic solution is advantageously employed in the chemical etching. The etching is undertaken such that the resulting depressions exhibit undercuts which additionally provide for a mechanical bonding between the adhesive layer and the roughened surface. Such etching may be accomplished with a caustic solution such as sodium hydroxide.

In another embodiment of the invention, the supporting surfaces provided with roughened areas can exhibit depressions caused by mechanical action. There are many possibilities for bringing about these depressions. A useful method involves effecting the depressions by embossings in the tool used in producing the supporting surfaces. Suitable tools have been described in German Pat. No. 3,315,417.

In order to effect the surface roughening as desired in the invention, these tool embossings are shaped such that the depressions produced in the supporting surfaces exhibiting inclined indentations with undercuts. These undercuts also provide that the adhesive layer is mechanically secured to the supporting surfaces.

BRIEF DESCRIPTION OF THE DRAWINGS

Embodiments of the invention are described below on the basis of the drawings.

FIG. 3 is a cross-section through two neighboring circular helices in a belt processed according to the invention.

FIG. 4 is a cross-section through two neighboring rectangularly shaped helices in another belt processed according to the invention.

FIG. 5 is a cross-section, V—V of FIG. 1, through two neighboring helices having flat supporting surfaces in a belt processed according to the invention.

FIG. 6 is a cross-section through two neighboring helices having flat supportiing surfaces and flat opposing surfaces in a further belt which was processed on both surfaces according to the invention.

FIG. 7 is an enlarged partial section through an embodiment of a roughened winding leg or supporting surface.

FIG. 8 is an enlarged partial section through an embodiment of a chemically roughened winding leg or supporting surface in accordance with the invention, and FIG. 9 is an enlarged partial section through an embodiment of a mechanically roughened winding leg or supporting surface in accordance with the invention.

DESCRIPTION OF PREFERRED EMBODIMENTS

The invention can be employed in connection with practically all belts, with supporting winding legs exhibiting any desired cross-sectional shape. In the following description, the invention is preferentially discussed and explained in connection with the belts described and claimed in U.S. patent application Ser. No. 513,986, now U.S. Pat. No. 4,606,792, which is incorporated herein by reference. Further, the invention is preferentially discussed and explained in connection with belts having spirals manufactured from synthetic monofilaments.

Figure 1:
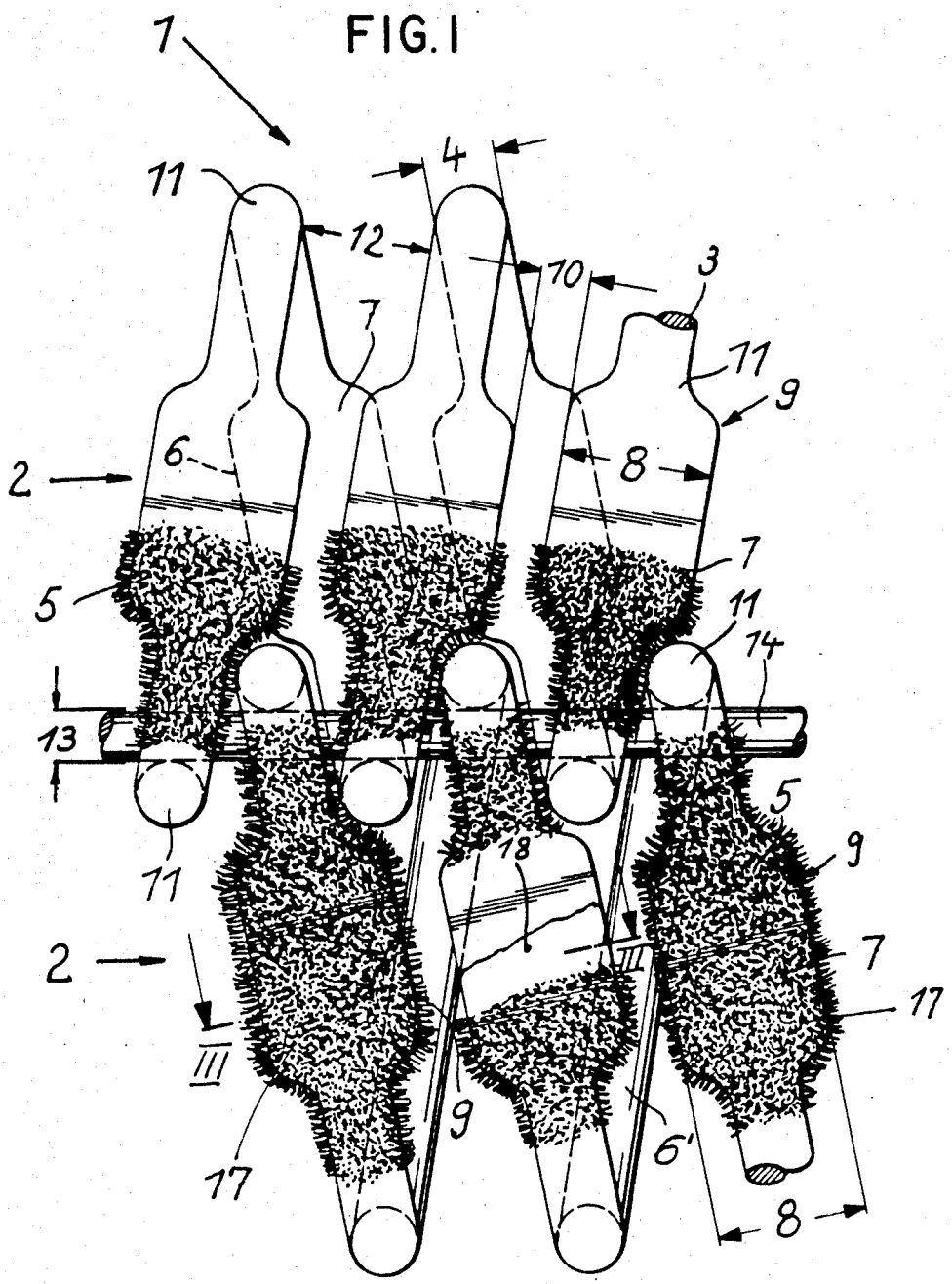
FIG. 1 is a section of a wire belt processed according to the invention.

FIG. 1 shows a top view of a partial section of a belt 1 with helices 2 consisting of plastic 3 originally having a circular cross-section with diameter 4. Such monofilament or threads 3 are wound into helices 2 and subsequently treated such that there are formed supporting winding legs 5 of a width 8 and exhibiting flat supporting surfaces 7 which are shown in cross-section in FIG. 5. Formation of the helices and the supporting surfaces 7 may be in accordance with the disclosure of U.S. patent application Ser. No. 513,986 and 602,413, now Pat. No. 4,599,881, which disclosures are incorporated herein by reference.

Also represented in the upper part of FIG. 1 are the opposing winding legs 6 with flat wide supporting surfaces 7, for example, likewise of width 8. A simplified cross-section of this construction with both surfaces modified in accordance with the invention is shown in FIG. 6.

In the lower part of FIG. 1, opposing winding legs 6' are shown which exhibit round cross-sections (see FIG. 5). In both embodiments depicted in FIG. 1, the supporting winding legs 5 and the opposing winding legs 6 or 6' are connected together by headcurves 11 between which there is a gap or intermediary space 12 into which protrudes an headcurve 11 of a neighboring helix 2, as can be seen in FIG. 1. As a result, there are formed overlapping areas 13 into which rods or pintles 14 are inserted.

The distance between the winding legs 5 or 6 or between their flat supporting surfaces 7 is denoted with 10. As a comparison of embodiments depicted in FIGS. 1–6 makes clear, this distance can vary depending on the mode of manufacture of the helices 2 and the desired fabric or belt design. As the width 8 is increased the distance 10 is decreased. This distance 10 determines to a substantial degree the passage of air through the wire belt 1 and is a major factor in establishing permeability. A small distance 10 lets only a small amount of air pass through a belt for drying of the paper web 19. Through a greater distance 10 between neighboring winding legs, the overall air-passage surface of a wire belt 11 is also enlarged. A further possibility for influencing the permeability of belt 1 is obtained according to FIG. 6 as a result of the fact that the winding legs 6 opposing the supporting loop flanks 5 are also provided with broad flat supporting surfaces 7. In belts whose helices 2 exhibit support winding legs 5' with round or rectangular cross-sections, FIG. 3 or 4, one obtains gaps 10 which correspond to the breadth of the headcurves 11. This results in a higher air permeability.

It will be further noted from a comparison of FIGS. 3 through 6, that the embodiments utilizing helices according to U.S. application Ser. Nos. 513,986 and 602,413 are of further advantage over the circular configuration of FIG. 3 or the rectangular configuration of FIG. 4. Thus, in FIGS. 5 and 6 the distance 10 is decreased without regard to the headcurves 11. On the other hand if one attempts to increase the width 8 in a circular or rectangular helix, such as FIGS. 3 or 4, the headcurves 11 is likewise increased.

Figure 2:
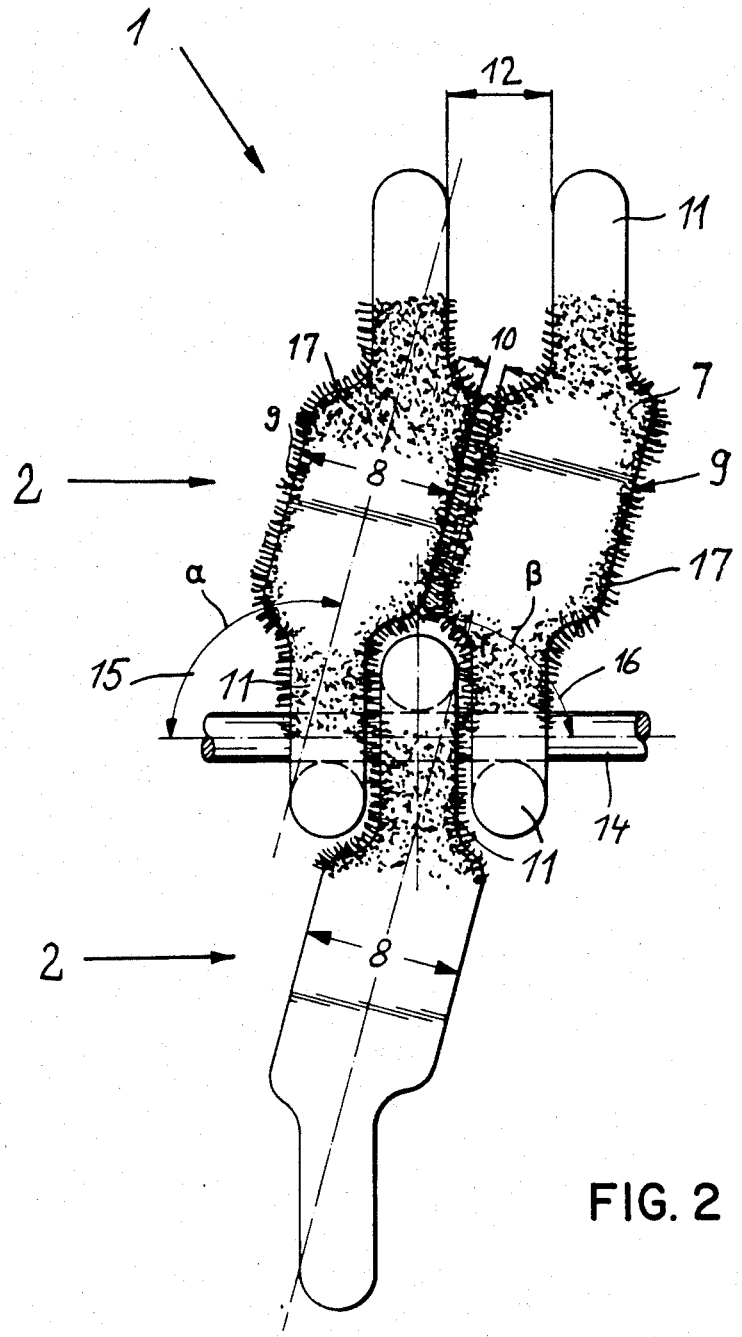
FIG. 2 is a section of another wire belt processed according to the invention.

In all of the embodiments of wire belts 1 known up to now, the air permeability is predetermined by gaps 10. This is also the case, for example, with a wire belt 1 a section of which is shown in FIG. 2. The helices 2 exhibit a play 15 with respect to the inserted rod 14 determined by an angle $\alpha$ between the longitudinal axis of the inserted rod 14 and the midline of a flat board supporting surface 7 which differs from a right angle. The headcurves 11, in contrast, run with a play 16 with respect to the midline of the inserted rod 14 which corresponds to right angle $\beta$. A more detailed description of play 15 may be found in application Ser. No. 513,986. A gap 10 between neighboring supporting surfaces 7 and an intermediary space 12 between neighboring headcurves 11 are also found in a wire belt 1 according to FIG. 2.

In order to compensate for irregularities in the contact surfaces of a belt 1, for example, in the flat supporting surfaces 7, which irregularities may cause problems in manufacturing very fine paper, and in order to compensate also for the point contact between the paper web 19, for example, in cross-sectionally round winding legs 5 and 6, and in order to simultaneously influence the passage of air through a wire belt, the invention utilizes means beyond the known measures described. According to the invention, the surfaces facing the paper web 19, preferably the supporting surfaces of winding legs 5 or 6, are provided with a layer 17 of fiber segments 21. This layer 17 is shown in FIGS. 1 and 2 in a top view. The surfaces of the belt facing the paper web 19, preferably the flat supporting surfaces 7 are covered with the fiber segments 21, which are explained in detail below. In order to be able to vary the passage of air in the zone with gap 10 between two supporting surfaces, a layer 17 of fiber segments 21 is also glued in preferred embodiments of the invention to the edge areas 9 of the supporting surfaces, in addition to the flat supporting surfaces 7. FIGS. 1 and 2 show top view of the layer 17 and edge areas 9 and the possibilities for influencing the flow of air through gap 10 between neighboring supporting surfaces. Likewise, it will be understood that permeability may be influenced by the use of only surface 17 or only edge areas 9. Thus, through use of edge areas 9 only it is possible to control permeability of the belt and still obtain surface marking, if so desired.

FIGS. 3–9 illustrate further details of the invention. The individually fiber segments 21 of layer 17 are firmly glued via an adhesive layer 18 to the supporting surfaces. The selection of adhesive layer 18, as will be understood by one skilled in the art, will depend upon the composition of the wire or thread 3 and the composition of the fiber segments 21. The orientation of individual fiber segments 21 (FIGS. 8 and 9) can be either generally perpendicular or more random so as to extend in all directions with respect to the adhesive layer 18. The fiber segments 21 preferably possess a diameter 23 of between 1.7 and 25 dtex or between 1 and 25 denier and a length 22 of between 0.5 and 1 mm depending primarily upon on the intended use. In special cases, the fiber length 22 may be chosen up to 2 mm or greater. It will be recognized that the degree of flex in the fiber 21 will, to some extent, influence the length of the fiber as will be fibers resistance to shear stresses developed during the operation of the resulting belt. Especially FIGS. 3–9 show that the flow of air 20 can not only be controlled or influenced between neighboring helices in gap 10; rather, it can also move better under the paper web 19 than in the case of wire belts in which the paper web 19 lies directly on the supporting surfaces 17. The fiber segments 21 can consist of plastic, such as, in particular, aramids, polyaryletherketones, polyamide, polyester, or viscose. However, one can also employ fiber segments 21 of natural material, such as wool or cotton, or even a mixture of natural and synthetic fibers. Thus, one is free to select fiber segments 21 which are compatible with the belt design and end use, so long as the fiber segments are capable of application to the host belt.

In order to secure the fiber segments 21 reliably on the supporting surfaces or their edge areas, these surfaces should be provided with a roughening 24, which can be caused, for example, by electric spark erosion or even chemically or mechanically. Mechanical roughening 24 can be effected, for example, by the tool used in manufacturing the broad supporting winding legs 5 according to U.S. patent application No. 602,413. For accomplishing this, the tools will preferably be provided with appropriately machined surfaces.

With respect to the roughening of the surface, it will be understood that the need for such roughening or the degree thereof will be determined by material selection. At the least the surface must be free and clean of yarn sizing and machine oils.

FIG. 8 shows a partial cross-section through a supporting winding leg 5 in which depressions 25 have been introduced through chemical treatment, for example, by an appropriate caustic solution, such as sodium hydroxide. Through their production, these depressions can obtain undercuts 26, which contribute to the adhesive layer 18 being secured to the winding legs not only through the adhesive action, but also mechanically. With the aid of electrical fields, the fiber segments 21 are then applied to the adhesive layer 18, their tips, as FIG. 8 shows, penetrating in part into the adhesive layer 18.

In the case of spark erosion, which applies primarily to metal belts, the belt enters an electro-discharge machine in which the spark discharge takes place between a positive electrode and the grounded belt. In a preferred embodiment the distance between the electrode and the belt is approximately 0.2 cm, the electrode is running in the cross wire above the belt and the applied voltage is approximately 1000 volts.

In the case of mechanical roughening of the supporting surfaces, depressions 27 are formed which again exhibit undercuts 28. These depressions 27 also provide for additional mechanical bonding between the surfaces of the winding leg 5, 6 and the adhesive layer 18. FIGS. 1 and 2 show that not only the edge areas 9 and the supporting surfaces, but also regions of the headcurves 11 which can come into contact with the paper web 19 can be glued with a layer 17 of fiber segments 17.

In the event that one does not desire to apply fiber segments 21 to form the layer 17, the adhesive may be removed by doctoring so that segments 21 only adhere to the areas such as 9. Additionally, if so desired fiber segments may be applied to the entire belt and then the segments 21 forming layer 17 are sheared. In this manner one achieves a smoothing of the surface irregularaties of the support loops 5 and the control of permeability resulting from the fiber segments in areas 9 and possibly 11.

It is thought that during use of a wire belt 1 glued with a layer 17, wear of the fiber segments 21 takes place which results in the formation of a fine dust. Also occurring, however, is abrasion of the transported paper web 19. The inventive layers 17 of fiber segments 21 exercise in an unused wire belt a very specific and measurable influence on air flow 20 and thus on the air permeability of the belt 1. Likewise, the areas 9 exercise an influence on the permeability of the belt. This permeability is determined by the density of the layer 17 and by the length 22 and diameter 23 of the fiber segments 21. In those cases where fiber segments 21 are provided in area 9, they will combine with the effect of layer 17 to determine the permeability.

This permeability would be expected to increase over the course of time as a result of wear of the fiber segments 21. Since, however, the dust from the abrasion of the fiber segments 21 as well as the abrasion of the paper web 19 becomes more or less secured between the fiber segments 21, it is expected that the permeability of the wire belt is not significantly influenced. Tests have revealed that the permeability of the wire belt can be held over its entire service life to the initial value as a result of this wear, on the one hand, and the clogging of intermediary spaces between fiber segments, on the other. Through the invention, it is possible to make available wire belts with a permeability which remains substantially constant.

In the above mentioned tests, the belt was prepared in accordance with the following description and tested as set forth hereinafter. A new belt in accordance with the instant invention was prepared with fiber segments 21 in the layer 17 and in the area 9. The fiber segments were chosen to have a length of about 2 milimeters and the permeability of the belt was approximately 200 CFM. After an operating period of approximately 4 weeks, the length of the fiber segments had decreased to approximately 1.7 mm. The dust from the abrasion of the fiber segments 21, as well as the abrasion of the paper web carried thereon. had become secured among the fiber segments 21 with the result that the air permeability at the end of the test was approximately 195 CFM. Accordingly, it can be seen that the belt maintained substantially the same permeability throughout the test period.

We claim:

1. Endless belt for paper machines or the like, with a number of helices which consist of opposing winding legs and headcurves joining said winding legs together and into whose intermediary spaces the headcurves of the neighboring helix are entered to a degree that there develops between the two helices a range of overlapping into which a pintle rod is inserted, characterized by the fact that at least the supporting winding legs (5 or 5') of the helices (2) are provided with a layer (17) of fiber segments (21), further characterized by said layer of fiber segments (21) being individual fibers which are independently adhered to the winding legs (5 or 5').

2. Belt according to claim 1, characterized by the fact that the supporting winding legs (5) exhibit flat supporting surfaces (7) which are provided with an adhesive layer (18) with respect to which the fiber segments (21) of layer (17) are oriented in an essentially perpendicular direction.

3. Belt according to claim 2, characterized by the fact that the edge areas (9) of the flat supporting surfaces (7) are also provided with an adhesive layer (18) with respect to which the fiber segments (21) of layer (17) are positioned in a substantially perpendicular direction.

4. Belt according to claim 1, 2, or 3, characterized by the fact that the fiber segments (21) are synthetic fibers.

5. Belt according to claim 4, characterized by the fact that the fiber segments (21) exhibit a length between 0.5 and about 2 mm and a diameter between 1.7 and 25 dtex.

6. Belt according to claim 1, 2, or 3, characterized by the fact that the fiber segments (21) are selected from the group which consist of aramid, polyaryletherketone, polyamide, polyester, or viscose.

7. Belt according to claim 6, characterized by the fact that the fiber segments (21) exhibit a length between 0.5 and about 2 mm and a diameter between 1.7 and 25 dtex.

8. Belt according to claim 1, 2, or 3, characterized by the fact that the fiber segments (21) are natural fibers.

9. Belt according to claim 1, 2, or 3, characterized by the fact that the fiber segments (21) consist of wool or cotton.

10. Belt according to claim 1, 2, or 3, characterized by the fact that the fiber segments (21) are a blend of synthetic and natural fibers.

11. Belt according to claim 1 or 2, characterized by the fact that the winding legs (6 or 6') of the helices (2) opposing the paper web (19) supporting winding legs (5 or 5') are also provided with a layer (17) of natural fiber segments (21) and/or synthetic fiber segments (21).

12. Belt according to claim 2 or 3, characterized by the fact that its surfaces (7) or areas (9) provided with an adhesive layer are roughened.

13. Belt according to claim 3, characterized by the fact that its surfaces (7) or areas (9) are provided with roughenings (24) that exhibit depressions (25) caused by chemical etching.

14. Belt according to claim 13, characterized by the fact that the chemically etched depressions (25) exhibit undercuts (26).

15. Belt according to claim 3, further characterized by the fact that its surfaces (7) or areas (9) are provided with roughenings (24) that exhibit depressions (25) caused by chemical etching with a caustic solution.

16. Belt according to claim 3, further characterized by the fact that its surfaces (7) or areas (9) are provided with roughenings (24) that exhibit depressions (27) caused by mechanical action.

17. Belt according to claim 16, characterized by the fact that the mechanically caused depressions (27) exhibit inclined indentations with undercuts (28).

18. Belt according to claim 3, further characterized by the fact that its surfaces (7) or areas (9) are provided with roughenings (24) that exhibit embossings effected by the tool used in producing the supporting surfaces.

19. An improved papermakers belt of the type having a plurality of interconnected helices, each of said helices having complementary headcurves along the edges thereof and supporting winding legs extending between said headcurves, wherein the improvement consists of at least said supporting winding legs having a layer of fiber segments secure thereto, said layer of fiber segments further consisting of individual fibers which are independently adhered to the winding legs.

20. An improved helix for use in a papermakers belt having a plurality of interconnected helices of the type having a support area joining headcurves of the helix wherein said improved helix has a support area with a layer of fiber segments thereon, said layer of fiber segments further consisting of individual fibers which are independently adhered to winding legs.

21. An improved helix for use in a papermakers belt having a plurality of interconnected helices of the type having a support area joining headcurves of the helix wherein said improved helix has a layer of fiber segments adhered to at least the edges of said support area, said layer of fiber segments being individual fibers which are independently adhered to the edges of said support area.

* * * * *